US006798155B2

(12) United States Patent
Kim et al.

(10) Patent No.: US 6,798,155 B2
(45) Date of Patent: Sep. 28, 2004

(54) COLOR IMAGE DISPLAY DEVICE

(75) Inventors: Ji Hyun Kim, Kyungsangbuk-Do (KR); Man Ho Heo, Kyungsangbuk-Do (KR); Jong Ho Lim, Kyungsangbuk-Do (KR)

(73) Assignee: LG. Philips Display Co., Ltd., Kyungsangbuk-do (KR)

( * ) Notice: Subject to any disclaimer, the term of this patent is extended or adjusted under 35 U.S.C. 154(b) by 0 days.

(21) Appl. No.: 10/244,739

(22) Filed: Sep. 17, 2002

(65) Prior Publication Data

US 2003/0214261 A1 Nov. 20, 2003

(30) Foreign Application Priority Data

May 15, 2002 (KR) ..... 2002-26921
Jun. 10, 2002 (KR) ..... 2002-32245

(51) Int. Cl.[7] ..... G09G 1/28

(52) U.S. Cl. ..... 315/368.21; 315/368.18; 313/414

(58) Field of Search ..... 315/368.21, 368.22, 315/368.18, 368.11, 364, 368.15, 382.1, 383, 395, 403, 404; 313/414, 415, 413

(56) References Cited

U.S. PATENT DOCUMENTS 3,678,329 A * 7/1972 Miyaoka ..... 315/13.1
4,786,845 A * 11/1988 Kato et al. ..... 315/382
5,519,290 A * 5/1996 Sugawara et al. ..... 315/382.1
5,668,435 A * 9/1997 Uchida et al. ..... 313/414
5,719,475 A * 2/1998 Shishido ..... 315/368.15
6,407,494 B1 * 6/2002 Maehara et al. ..... 313/461

FOREIGN PATENT DOCUMENTS

JP 06-125511 A 5/1994
JP 2000-125225 A 4/2000
KR 10-0258982 B1 3/2000

* cited by examiner

*Primary Examiner*—Tuyet T. Vo
(74) *Attorney, Agent, or Firm*—Birch, Stewart, Kolasch & Birch, LLP

(57) ABSTRACT

A color image display device has an auxiliary means for compensating brightness simply and inexpensively by using an electron gun of a cathode ray tube. Brightness uniformity is improved in the image display device having a flat-type color cathode ray tube with a glass panel having a high wedge ratio and a low transmissibility. The color image display includes a panel housing a screen on an inner face thereof, a funnel engaged with the panel; an electron gun engaged with a neck portion of the funnel for emitting electron beams toward the screen, a deflection device for displaying an image by deflecting the electron beams emitted from the electron gun in horizontal and vertical directions with respect to the screen, and a cathode ray tube including a shadow mask aligned from the screen at a predetermined distance. The color image display device has an electron gun which includes a triode section having a cathode for generating electron beams, a grid electrode aligned to be adjacent to the cathode and an accelerating electrode aligned to be adjacent to the grid electrode. A video signal voltage is applied to the cathode, and a variable voltage is applied to the grid electrode or accelerating electrode.

18 Claims, 10 Drawing Sheets

A RELATIONSHIP BETWEEN BEAM CURRENT AND BRIGHTNESS

A RELATIONSHIP BETWEEN THICKNESS OF GLASS AND TRANSMISSION

A THICKNESS OF GLASS IN ACCORDANCE WITH POSITIONS

A TRANSMISSION IS OVER 75%
A WEDGE RATIO IS 170%

A TRANSMISSION IS OVER 75%
A WEDGE RATIO IS 230%

A TRANSMISSION IS RANGED 45~75%
A WEDGE RATIO IS 170%

A TRANSMISSION IS RANGED 45~75%
A WEDGE RATIO IS 230%

A TRANSMISSION IS LESS THAN 45%
A WEDGE RATIO IS 170%

A TRANSMISSION IS LESS THAN 45%
A WEDGE RATIO IS 230%

COLOR IMAGE DISPLAY DEVICE

BACKGROUND OF THE INVENTION

1. Field of the Invention

The present invention relates to a color image display device, and in particular, to an improvement of brightness uniformity throughout an entire screen in an image display device having a flat-type color cathode ray tube with a high wedge ratio.

2. Description of the Related Art

A conventional color cathode ray tube is a display device generating an image emitting electron beams from an electron gun 10, beams of which are deflected by a deflection yoke 6 and pass through a shadow mask, and arrive at a fluorescent film 7, which is coated with a fluorescent body.

The conventional color cathode ray tube comprises a cathode 3 for inputting video signals, a heater 2 for generating thermal electrons by heating the cathode 3, a grid electrode for controlling the quantity of electron beams by means of a voltage difference from the cathode 3, an electron gun 10 including a triode section, which comprises an accelerating electrode 5 for accelerating the electron beams passed though the grid electrode 4, an 20 anode 9 for applying a high voltage for applying the generated electron beams to a fluorescent body 7, and a deflection yoke 6 for redirecting the electron beams to arrive at the fluorescent body 7 at a desired position.

The cathode ray tube having the above construction is operated as follows. Thermal electrons, which have been generated from the cathode 3 and heated by the heater 2, are accelerated toward the fluorescent body 7 by means of a high voltage on the anode 9 in an amount as proportional to the video signals inputted to the cathode. The fluorescent body 7 becomes luminescent due to collision with the accelerated thermal electrons, and displays an image on a screen. In order to enable the electron beams to arrive at the fluorescent body at a predetermined position, it is critical to generate a magnetic field by flowing a saw wave current from the deflection yoke 6, and allowing the electron beams to pass through the magnetic field and receive a magnetic force ($F=-eV\times B$).

The quantity of electron beams emanated from the cathode 5 is determined by the voltage difference between the video signal voltage applied to the cathode and the voltage applied to the grid electrode. Assuming that the grid electrode voltage is constant (0V), the beam current becomes inversely-proportional to the cathode voltage.

The conventional cathode ray tube having a curved face has almost the same curve ratio between the inner face and outer face of a screen. Since the inner face of the screen of a panel has a remarkably greater curve ratio than the outer face of the screen, the distance to be covered by the movements of electron beams that have been emitted from the electron gun should be greater around the edge area than around the middle area of the screen. Such differences in distance to be covered by the movements of electron beams pose a problem of deteriorating uniformity in the overall brightness (white balance) due to less brightness around the edge area of the screen than in the middle area of the screen when the electron beams of the same quantity are emitted.

To resolve the above problem, Korean Patent Publication No. 10-0258982 (laid open on Jul. 5, 1999) suggests a monitor, comprising a parabola signal generating section 107 as shown in FIG. 2 for generating a parabola signal, a first video output signal generating section 106 for outputting a first video output signal, which has been adjusted to a brightness adjusting voltage from a black level voltage based on a video input signal, carrying an image with the black level voltage as well as on and input of the brightness adjusting voltage to adjust brightness of the screen, a signal synthesizing section 108 for outputting a second video output signal, which incorporates the parabola signal into the first video output signal based on an input of the first video output signal 106 and the parabola signal, and a brightness adjusting section 101 of the screen.

As shown in FIG. 3, Japanese Laid-Open Patent Publication No. 2000-125225 (laid open on Apr. 28, 2000) also suggests a technology for correcting a brightness level in a pixel unit by means of a function having a predetermined pixel reference position with respect to the video brightness signal as well as a distance of a video display pixel position as factors.

The method for compensating deterioration of the brightness around an edge area is to display the video signals in accordance with positions thereof on the screen. However, it requires a very complicated and expensive brightness compensation circuit to convert the video signals inputted in real time through an antenna. Further, this kind of brightness compensating method is used to resolve the brightness imbalance due to differences in distance to be covered by the movements of electron beams of the cathode ray tube, etc.

With the recent launching of a cathode ray tube having an almost flat outer face of the screen, however, the thickness difference between the middle area and the edge area of the screen has become greater. This weakens the strength of the flat outer face of the screen by differentiating the curve ratios between the inner face and outer face of the screen in the cathode ray tube. This is generally expressed by a wedge ratio. The wedge ratio of a flat-type panel having a flat outer face and a curved inner face ranges up to 230% at the maximum and down to 170% at the minimum. Brightness difference is created with respect to the same signal due to the thickness difference. In an effort to overcome such a brightness difference, a panel is generally manufactured for the screen using clear glass of very high transmissibility. Since the clear glass has a transmissibility of about 80%, a brightness difference is created with respect to the same beam current by the thickness difference in accordance with positions of the screen glass. Thus, efforts have been exerted to obtain uniform brightness through either graded coating or attachment of films with different transmissibility to each position of the screen glass so as to differentiate the transmissibility in accordance with positions thereof on the screen. It is irrational to conclude that uniform brightness cannot be obtained if tint glass with transmissibility of about 50% is used, when the wedge ratio is high, either to elevate quality of the cathode ray tube or to lower the manufacturing cost.

SUMMARY OF THE INVENTION

It is, therefore, an object of the present invention to provide a color image display device having an improvement of brightness uniformity throughout an entire screen in an image display device have a flat-type cathode ray tube with a high wedge rate.

To achieve the above object, there is provided a color image display device, comprising: a panel housing a screen on an inner face thereof; a funnel engaged with the panel; an electron gun engaged with a neck portion of the funnel for emitting electron beams toward the screen; a deflection device for displaying an image by deflecting the electron beams emitted from the electron gun in horizontal and vertical directions with respect to the screen; and a cathode ray tube including a shadow mask aligned from the screen at a predetermined distance, characterized in that the electron gun includes a triode section having a cathode for generating electron beams, a grid electrode aligned to be adjacent to the cathode and an accelerating electrode aligned to be adjacent to the grid electrode, a variable voltage being applied to the grid electrode or accelerating electrode.

The electron gun of the color image display device according to the present invention preferably includes: a triode having a cathode for generating electron beams in accordance with inputted video signal voltage, a grid electrode aligned to be adjacent to the cathode, and an accelerating electrode aligned to be adjacent to the grid electrode.

The color image display device further comprises a brightness compensating device for applying a brightness compensating voltage for compensating a brightness difference in accordance with thickness of the panel glass to the grid electrode or the accelerating electrode, the brightness compensating voltage being variable depending on the beam current emitted from the cathode.

BRIEF DESCRIPTION OF THE DRAWINGS

The above object, features and advantages of the present invention will become more apparent from the following detailed description when taken in conjunction with the accompanying drawings, in which.

DETAILED DESCRIPTION OF THE PREFERRED EMBODIMENTS

Figure 1:
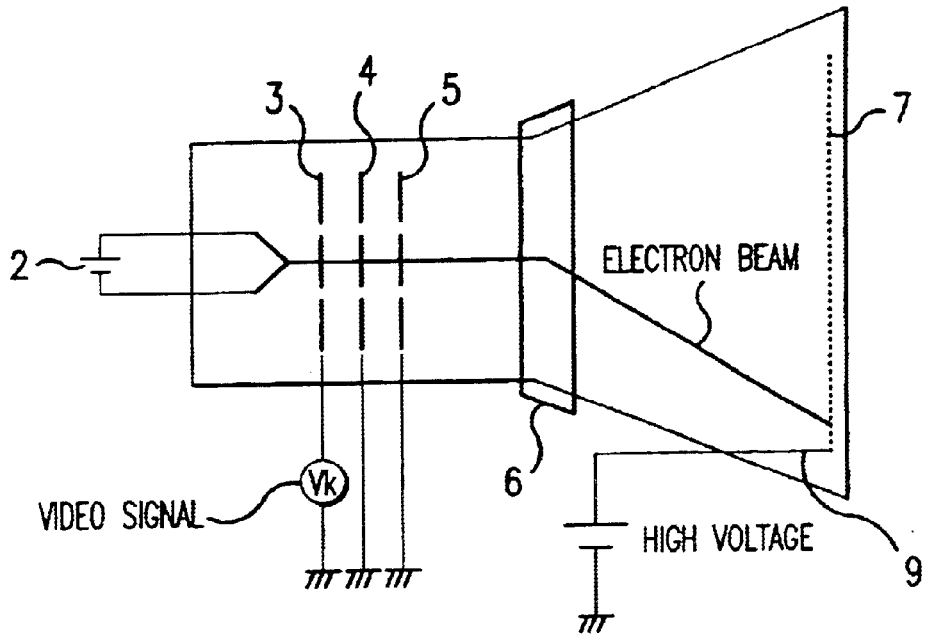
FIG. 1 is a diagram illustrating an operational mechanism of a conventional color cathode ray tube.
Figure 2:
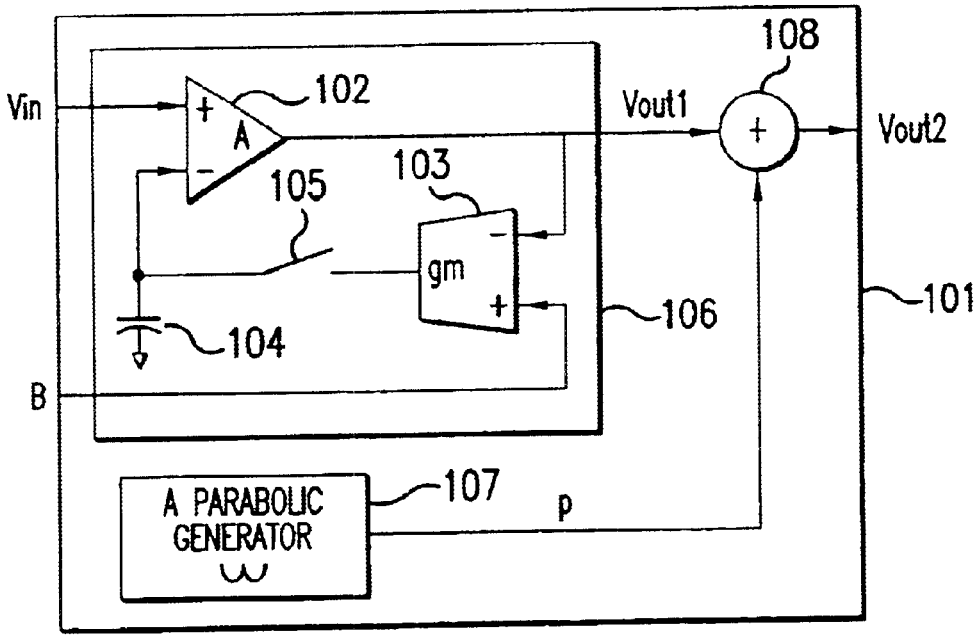
FIG. 2 is a block diagram illustrating a construction of a conventional brightness compensating device.
Figure 3:
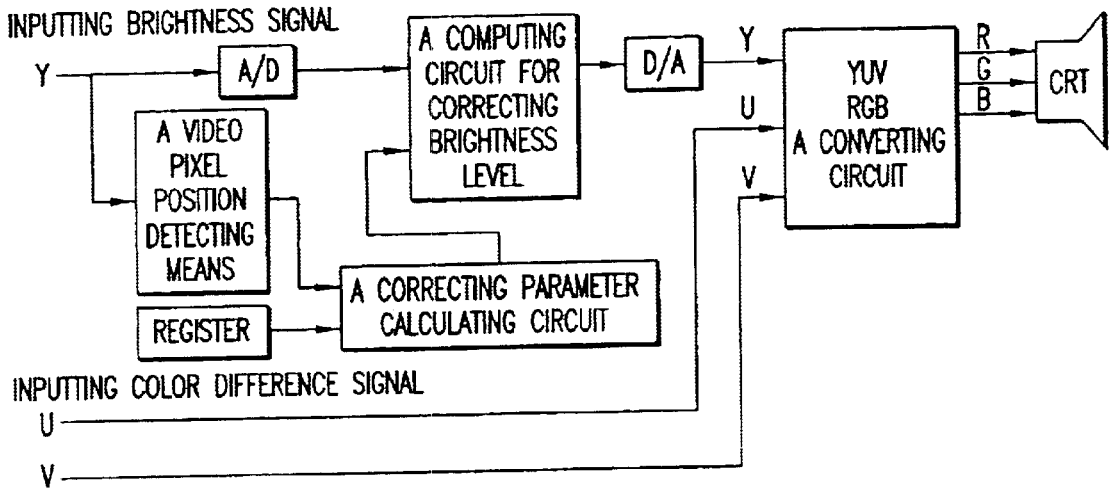
FIG. 3 is a block diagram illustrating a construction of another conventional brightness compensating device.

Preferred embodiments of the present invention will now be described with reference to the accompanying drawings. In the following description, same drawing reference numerals are used for the same elements even in different drawings. The matters defined in the description such as a detailed construction and elements of a circuit are provided to assist in a comprehensive understanding of the invention. Thus, it is apparent that the present invention can be carried out without those defined matters. Also, well-known functions or constructions are not described in detail since they would obscure the invention in unnecessary detail.

An amount of beam current flowing in the cathode ray tube can be controlled by varying the voltage between the grid electrode and the cathode of the cathode ray tube. Within the operational scope of using the cathode ray tube, a less amount of current flows if the voltage difference between the grid electrode and the cathode becomes greater [no current flows if the voltage difference is higher than the cut-off voltage], while more current flows if the voltage difference between the grid electrode and the cathode becomes smaller.

Figure 8A:
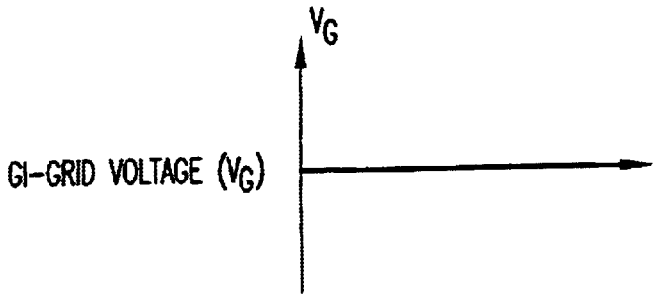
FIGS. 8*a* to 8*d* are voltage waveforms in a triode of a conventional electron gun.
Figure 8B:
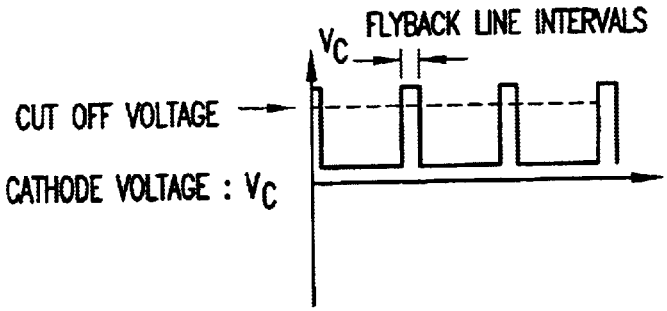
Figure 8C:
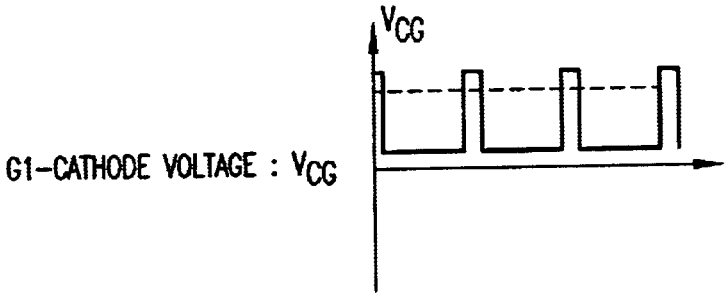
Figure 8D:
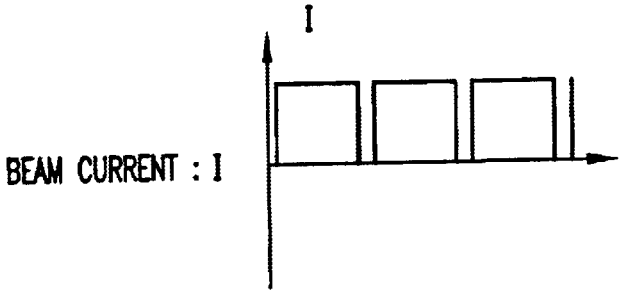

As shown in FIG. 1, the conventional cathode ray tube operates as follows. The grid electrode is grounded and a video signal as shown in FIG. 8*b* (a white signal) is applied to the cathode so that a voltage $V_{CG}$ can be loaded between the grid electrode and the cathode, and that current I can flow inversely-proportional to the voltage $V_{CG}$ in the cathode ray tube to control beam current. The intervals of high voltage depicted in narrow width in FIG. 8*b* are flyback line intervals, in which no current flows because the voltage is higher than the cut-off voltage (limited voltage disabling beams to flow).

If the amount of current is controlled by the conventional method as described above, same beam current flows on a video signal level of the same voltage. Thus, the amount of beam current arriving at the fluorescent body in the middle area of the panel is equal to the current arriving at the fluorescent body around the edge area of the panel. Even though the same amount of light is emitted from the fluorescent body, the brightness becomes lower around edge area than around middle area because the thickness of the panel glass is greater and the optical transmissibility is lower around the edge area than in the middle area thereof.

Figure 4A:
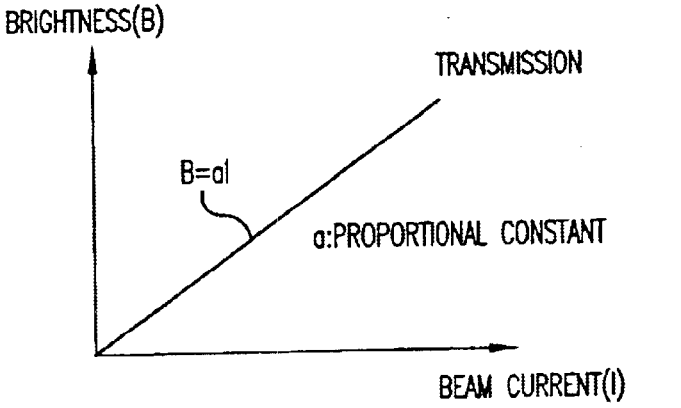
FIGS. 4*a* to 4*c* are graphs illustrating relationships between beam current and brightness, thickness of the glass and optical transmissibility, as well as thickness of the glass in accordance with the positions thereof on the screen.
Figure 4B:
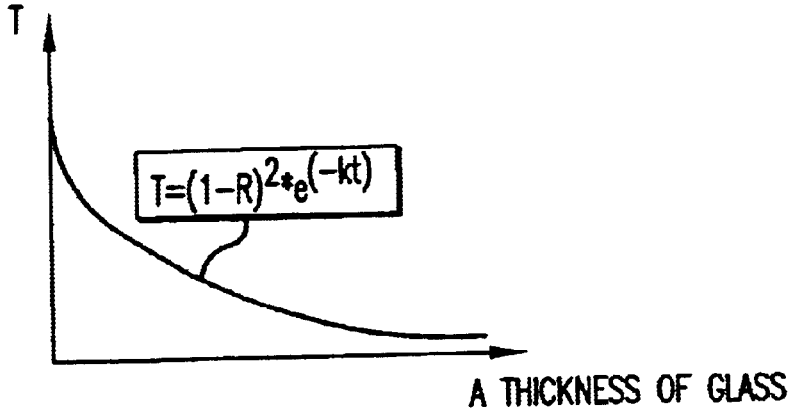
Figure 4C:
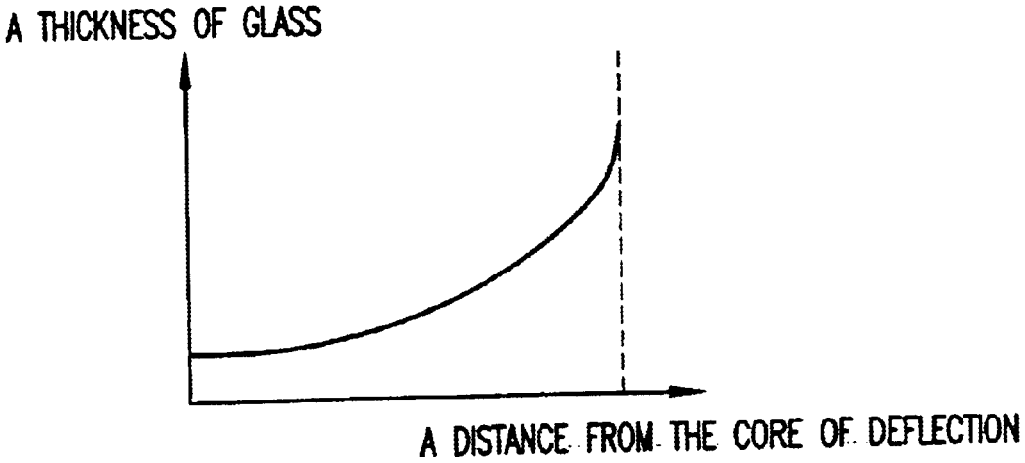

In general, the amount of light generated by emitting a fluorescent body with electron beams is proportional to the amount of electron beam current as shown in FIGS. 4*a* to 4*c*. The light emitted from the fluorescent body reaches human eyes through the glass. In the process of passing through the glass, however, some amount of the light is absorbed, while the remaining amount thereof passes through the glass. Here, if glass of the same material is used, the glass becomes thicker as the position becomes farther from the core of deflection, as shown in FIG. 4*c*. Further, transmissibility of the glass is variable depending on the thickness of the glass, as shown in FIG. 4*b*. As the glass becomes thicker, the amount of light passing through the glass becomes less.

For this reason, the same amount of light is generated when the same beam current strikes the fluorescent body around the middle area and edge area of the cathode ray tube. However, as shown in the drawing of the left side in FIG. 5, the thickness of the glass around the middle area A of the panel of the cathode ray tube differs from that of the glass around the edge area B (A is thinner than B). Thus, as shown in the drawing of the right side in FIG. 5, the amount of light passed through the glass becomes less in B than in A.

The transmissibility of light, which is incident to the glass by emission of the fluorescent body and passed through the glass (transmitted amount of light/incident amount of light), can be expressed in a graph, as shown in FIG. 4*b*, and can be expressed by the following equation, if the transmissibility is represented by T; a reflecting ratio is represented by R; an absorbancy index is represented by k; and thickness of the glass is represented by t:

$$T=(1-R)^{2*}e^{(-kt)}$$

Figure 6A:
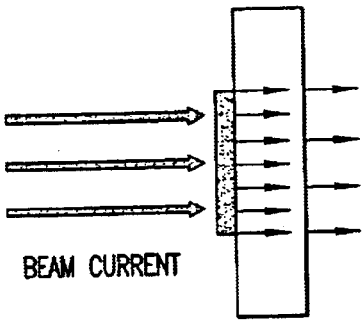
FIG. 6 is a diagram illustrating a mechanism of compensating brightness in accordance with thickness of the glass.
Figure 6B:
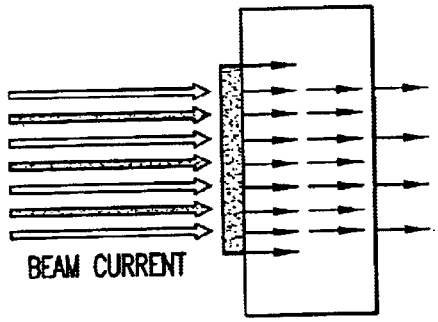

To compensate for the brightness variable with different transmissibility depending on a thickness of the glass, the present invention employs a mechanism such that a lower amount of beam current arrives at the fluorescent body of the thin glass, as shown in FIG. 6*a*, and a greater amount of beam current arrives at the fluorescent body of the thick glass. Hence, the amount of light emitted from the fluorescent body becomes relatively greater in the thick glass than in the thin glass, thereby equalizing the amount of light passing through the thick glass with that passing through the thin glass even if the thick glass has lower transmissibility.

Figure 7:
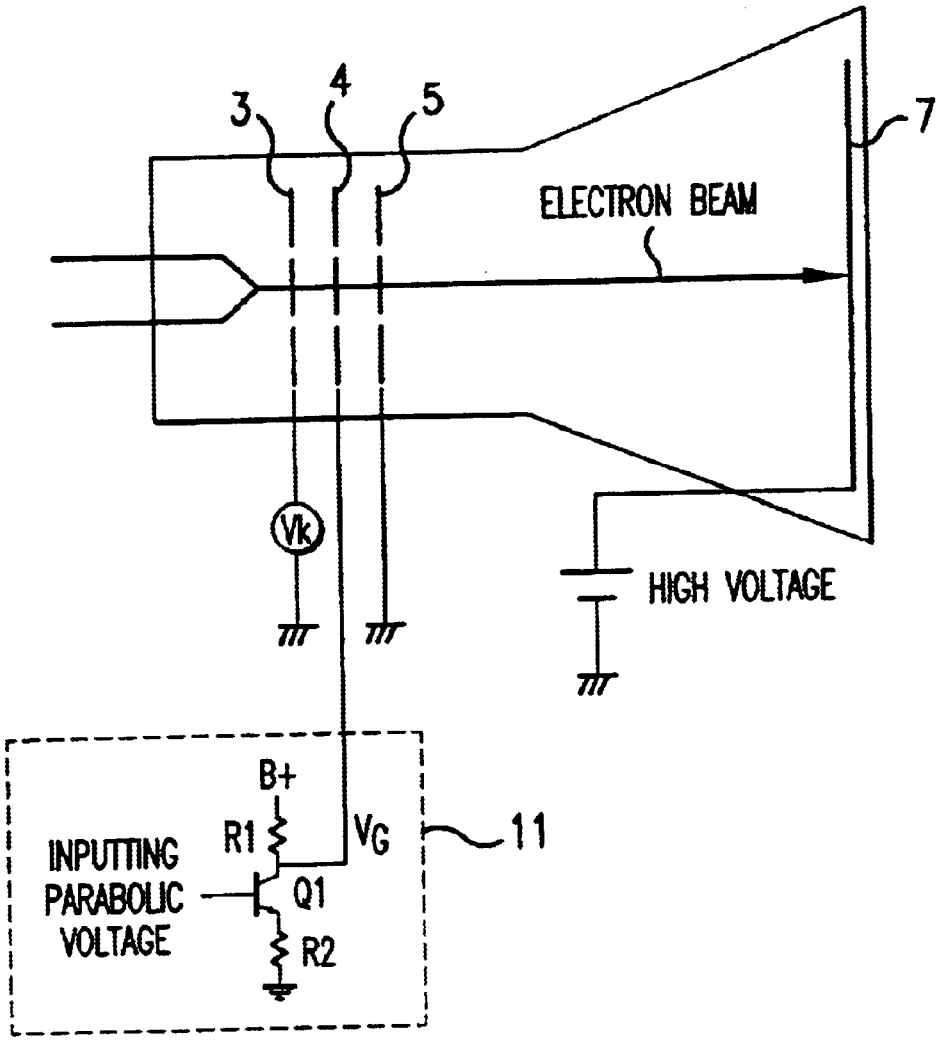
FIG. 7 is a diagram illustrating a mechanism of compensating for brightness according to an embodiment of the present invention.

According to the above mechanism as shown in FIG. 7, the present invention additionally provides a brightness compensating circuit 11 to the electron gun 10 of the cathode ray tube for controlling the electron beam current so as to correct the difference in brightness variable in accordance with the thickness difference in the glass of the panel in the grid electrode 4, which is one of the terminals for controlling the amount of beam current.

In order to control the amount of beam current for compensating a brightness difference in accordance with the thickness of the glass, as described above, the present invention inputs in the grid electrode 4 a voltage waveform for compensating brightness to control the current instead of grounding the voltage 0V around the grid electrode 4 of the conventional cathode ray tube as shown in FIG. 1.

Figures 9A, 9B, 9C, 9D:
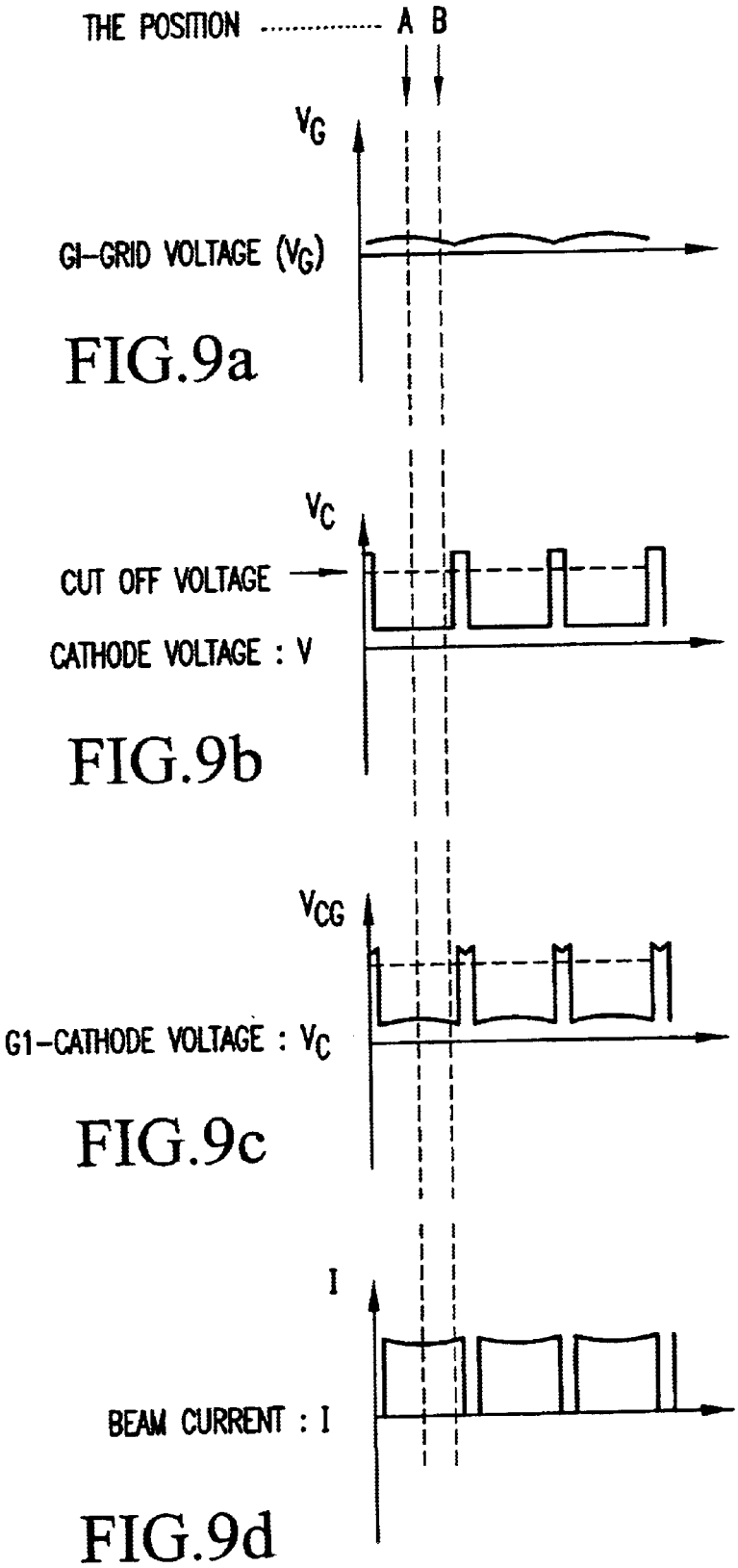
FIGS. 9*a* to 9*d* are voltage waveforms in a triode of an electron gun according to the present invention.
Figure 10A:
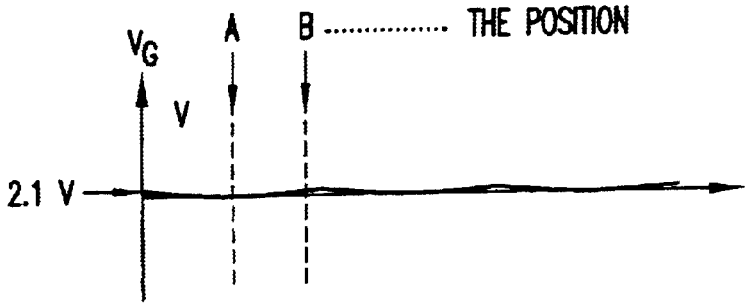
FIGS. 10*a* to 10*f* are compensating voltage waveforms in accordance with transmissibility and wedge ratio of the glass.
Figure 10B:
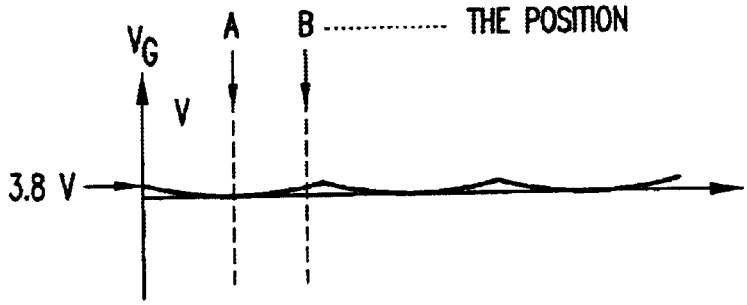
Figure 10C:
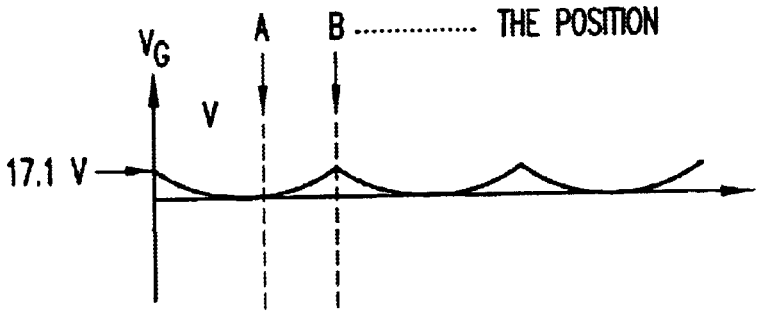
Figure 10D:
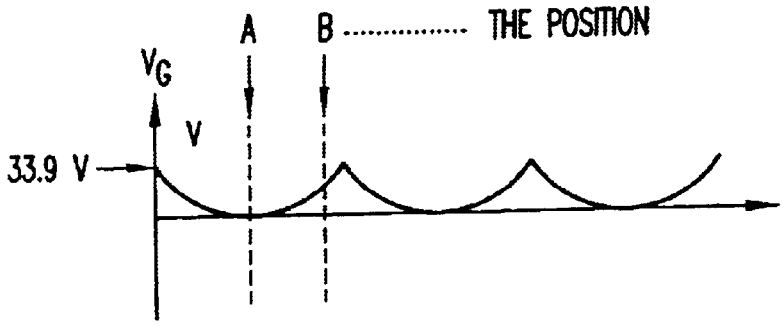
Figure 10E:
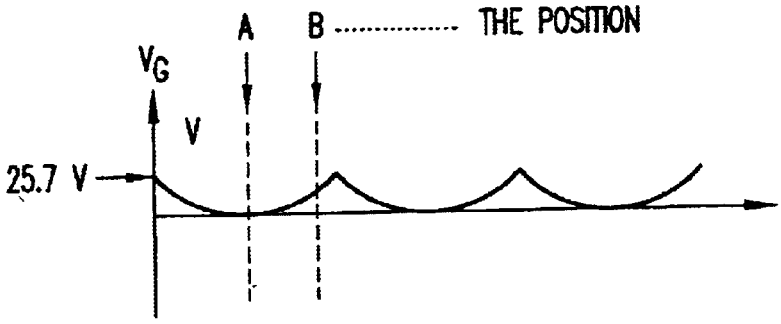
Figure 10F:
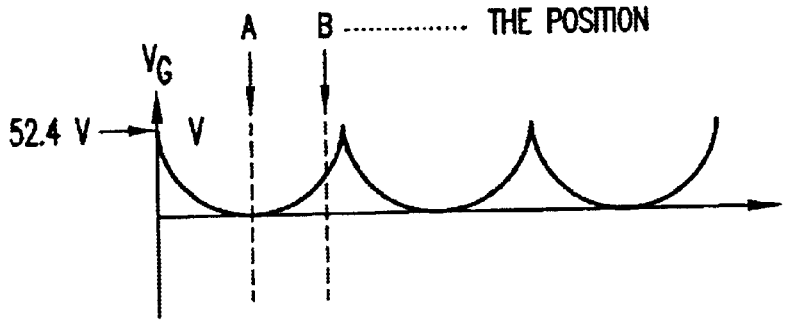

To correct the brightness difference described above, the present invention does not apply a static voltage (0V in general) to the grid electrode of the cathode ray tube, unlike the conventional method. Rather, the present invention applies a voltage, which has a waveform calculated in accordance with the transmissibility as shown in FIG. 9*a*, so as to be low in the middle area and high around the edge area, thereby resulting in the waveform of the electric potential difference (electric potential difference between the grid electrode and the cathode" $V_{CG}$) from the video signal [$V_c$ in FIG. 9*b*] loaded on the cathode to be as shown in FIG. 9*c*. If the voltage of such a waveform is applied between the grid electrode and the cathode, a lesser amount of current arrives at the fluorescent body in the middle area A of the panel, while a greater amount of current (the amount of current calculated in accordance with the transmissibility so as to enable the same light as transmitted through the middle area to be transmitted) flows around the edge area, as shown in FIG. 9*d*. Thus, the same brightness can be generated regardless of the position on the panel.

According to the present invention, the brightness compensating voltage is applied to the grid electrode by the brightness compensating circuit 11 as shown in FIG. 7. Vertical and horizontal parabolic voltages are inputted in the brightness compensating circuit 11, as in case of a dynamic focus circuit of the conventional cathode ray tube. The parabola input voltage is applied to the grid electrode 4 through an amplifying terminal, which comprises a transistor Q1 and resistors R1, R2.

The same effect can be obtained by applying the parabolic voltage to the accelerating electrode 5 adjacent to the grid electrode 4, instead of applying the parabolic voltage to the grid electrode 4 by means of the brightness compensating circuit 11. A detailed description in this regard will be omitted here because the same mechanism as applied to the grid electrode 4 is applicable here also.

The following is a description of the relationship among the voltage applied to the grid electrode 4 of the brightness compensating circuit 11, as shown in FIG. 7, wedge ratio of the panel, and transmissibility of the panel.

In a case of the glass with different transmissibilities, it is necessary to discriminate the varied amount of beam current according to the varied thickness of the glass. For instance, if the thickness around the middle area is set to range between 12.5–14.5 mm and the thickness around the edge area is set to range between 25.5–29.6 mm so as to have a wedge ratio of about 204% in the glass for a cathode ray tube is generally known to be the clear glass, the brightness difference between the middle area and the edge area becomes 6.6% if the same level of beam current is used in those portions. In a case of the glass for a cathode ray tube generally known to be tint glass, and having the same thickness around the middle area and the same wedge ratio of about 204% as the clear glass, the brightness difference becomes 23.2% if the same level of beam current is used in the middle area and the edge area of the screen glass.

In addition, if the thickness of the middle area is set to range between 12.5–14.5 mm and the thickness of the edge area is set to range between 25.5–29.6 mm in the flat glass for a cathode ray tube generally known to be a dark tint glass so as to have a wedge ratio of about 204%, the brightness difference becomes 22.4% if the same level of beam current is used in the middle area and the edge area of the screen glass.

It is irrational to consider that the wedge ratio may be set to be greater and the beam current control range may be set to be greater than the aforementioned values if the curve ratio is set to be smaller than the aforementioned value for the purpose of improving howling characteristics and doming characteristics of a shadow mask. In a case of elevating the beam current only in general, however, difficulty lies in doubling the focus control capacity. Therefore, if the beam current control range is limited to be about 50% and 70% in case of a cathode ray tube for TV and monitors, respectively, it is possible to obtain the above characteristics economically without taking any particular measures for focus control in the electron gun. The panel employed in the flat-type cathode ray tube is shaped to have an almost flat outer face and an inner face of a predetermined curve ratio. The ratio between the middle area and edge area of the panel (the wedge ratio) is in the range of about 170–230%. In accordance with the transmissibility, the panel is classified into: the clear glass having the transmissibility of higher than 75% (absorbancy index k=0.00578); the tint glass having the transmissibility of 45–75% (absorbancy index k=0.04626), and the dark tint glass having the transmissibility of lower than 45% (absorbancy index k=0.06737). The tint glass or the dark tint glass is mainly used in a cathode ray tube of high quality to enhance contrast.

Figure 5:
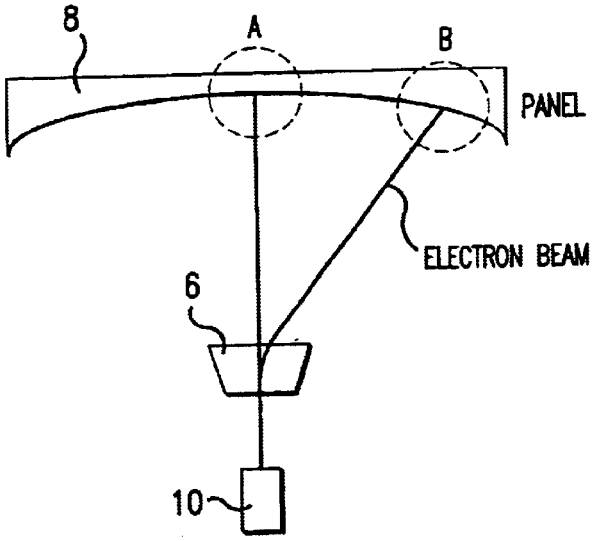
FIG. 5 is a diagram illustrating differences in optical transmissibility in accordance with thickness of a panel.
Figure 5A:
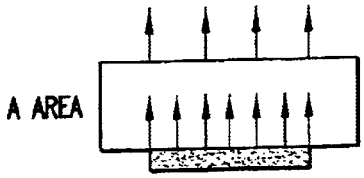
Figure 5B:
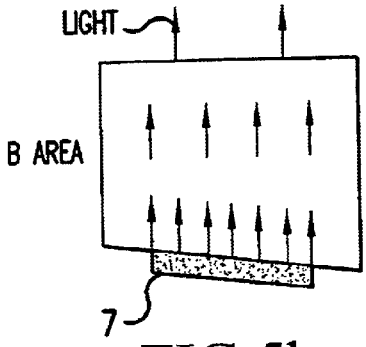

Assuming that the wedge ratio of the panel is in the range of 170–230%, and the thickness of area A in FIG. 5 is $d_A$, the thickness of B is $1.7d_B$. Accordingly, the transmissibility of area A can be expressed as $T_A=(1-R)^{2*}e^{(-kdA)}$, while the transmissibility of B can be expressed as $T_B=(1-R)^{2*}e^{(-kdB)}$. In other words, $T_B=(1-R)^{2*}e^{-k(1.7dA)}\sim(1-R)^{2*}e^{-k(2.3dA)}$.

Assuming that the amounts of light emitted from area A and B of the fluorescent body are $L_A$ and $L_B$, respectively, the amounts of light passing through the glass become $L_A\times T_B$, $L_B\times T_A$, respectively. The following equation should be satisfied to become $L_A\times T_B$, $L_B\times T_A$:

$$L_B = L_A \times (T_A / T_B)$$
$$= L_A \times [(1-R)^2 * e^{(-kdA)} / (1-R)^2 * e^{-kd(B)}]$$
$$= L_A \times [e^{(-kdA)} / e^{-kd(B)}]$$
$$= L_A \times [e^{k(dB-dA)}]$$

The range of the wedge ratio can be considered as follows:

$$L_B = L_A \times e^{k(17dA-dA)} \sim L_A \times e^{k(23dA-dA)}$$
$$= L_A \times e^{k(0.7dA)} \sim L_A \times e^{k(13dA)}$$

Here, assuming that the absorbancy index k of the clear glass is 0.00578, the thickness $d_A$ of area A is ranged 12.5–14.5 mm, $L_B$ should have the following value:

$$L_A \times e^{0.00578 \times 0.7 \times (12.5-14.5)} \leqq L_B \leqq L_A \times e^{0.00578 \times 1.3 \times (12.5-14.5)} \rightarrow (1.052\sim1.060)L_A \leqq L_B \leqq (1.098\sim1.115)L_A$$

Also, assuming that the absorbancy index k of the tint glass is 0.04626, the thickness $d_A$ of area A is ranged 12.5–14.5 mm, $L_B$ should have the following value:

$$L_A \times e^{0.04626 \times 0.7 \times (12.5-14.5)} \leqq L_B \leqq L_A \times e^{0.04626 \times 1.3 \times (12.5-14.5)} \rightarrow (1.499\sim1.599)L_A \leqq L_B \leqq (2.121\sim2.392)L_A$$

Further, assuming that the absorbancy index k of the dark tint glass is 0.06837, the thickness $d_A$ of area A is ranged 12.5–14.5 mm, $L_B$ should have the following value:

$$L_A \times e^{0.006737 \times 0.7 \times (12.5-14.5)} \leqq L_B \leqq L_A \times e^{0.006737 \times 1.3 \times (12.5-14.5)} \rightarrow (1.803\sim1.981)L_A \leqq L_B \leqq (2.988\sim3.561)L_A$$

The brightness of the fluorescent body is proportional to the beam current. Therefore, assuming that the thickness of area A is 12.5 mm, the brightness becomes comprehensively equal if voltage is applied to the grid electrode 4 so as to flow 1.052~1.098 times more the beam current $I_A$ of area A to the beam current $I_B$ of B in case of the clear glass; 1.499~2.121 times more the beam current $I_A$ of area A to the beam current $I_B$ of B in case of the tint glass, 1.803~2.988 times more the beam current $I_A$ of area A to the beam current $I_B$ of B in case of the dark tint glass in accordance with their respective wedge ratios.

Likewise, assuming that the thickness of area A is 14.5 mm, the brightness becomes comprehensively equal if voltage is applied to the grid electrode 4 so as to supply 1.060~1.115 times more the beam current $I_A$ of area A to the beam current $I_B$ of B in case of the clear glass; 1.599~2.392 times more the beam current $I_A$ of area A to the beam current $I_B$ of B in case of the tint glass; and 1.981~3.561 times more the beam current $I_A$ of area A to the beam current $I_B$ of B in case of the dark tint glass in accordance with their respective wedge ratios.

Setting the cut-off voltage $V_{cut}$ to be 180V and the white level voltage to be 70V, γ index becomes 3.04. Thus, the signal level applied to the cathode can be expressed by the following equation:

$$I=(180-V_{CG})^{V} \times 10^{-3}=(180-V_{CG})^{3.04} \times 10^{-6}(\text{mA})$$

Accordingly, when the signal level is white, the current I can be expressed by the following equation:

$$I=(180-70)^{3.04} \times 10^{-6}=1.61 \text{ mA}$$

As a result, if the thickness of area A is in the range of 12.5~14.5 mm and the wedge ratio is 170% in case of the clear glass, the current $I_B$ to be supplied to B is 1.61 mA×(1.052~1.060)=(1.69~1.71)mA. If the wedge ratio thereof is 230%, the current $I_B$ to be supplied to B is 1.61 mA×(1.098~1.115)=1.77~1.80)mA.

In addition, if the thickness of area A is ranged 12.5~14.5 mm and the wedge ratio is 170% in case of the tint glass, the current $I_B$ to be supplied to B is 1.61 mA×(1.499~1.599)=(2.41~2.57)mA. If the wedge ratio thereof is 230%, the current $I_B$ to be supplied to B is 1.61 mA×(2.121~2.392)=3.41~3.85)mA.

If the thickness of area A is ranged 12.5~14.5 mm and the wedge ratio is 170% in case of the dark tint glass, the current $I_B$ to be supplied to B is 1.61 mA×(1.803~1.981)=(2.90~3.19)mA. If the wedge ratio thereof is 230%, the current $I_B$ to be supplied to B is 1.61 mA×(2.988~3.561)=4.81~5.73)mA.

As described above, the required voltage to supply the current to B in accordance with the respective wedge ratios can be expressed by the following equations:

$$I=(180-V_{CG})^{3.04} \times 10^{-6}(\text{mA})$$

$$V_{CG}=180-(3.04 \times 10^{6})^{1/3.04}$$

The required voltage is as follows if the thickness of area A is in the range of 12.5~14.5 mm and the wedge ratio is 170% in case of the clear glass:

$$V_{CG}=180-\{(1.69\sim1.71) \times 10^{6}\}^{1/3.04}=(68.2\sim67.8)V$$

The required voltage is as follows if the wedge ratio thereof is 230%:

$$V_{CG}=180-\{(1.77\sim1.80) \times 10^{6}\}^{1/3.04}=(66.5\sim65.9)V$$

The required voltage is as follows if the thickness of area A is in the range of 12.5~14.5 mm and the wedge ratio is 170% in case of the tint glass:

$$V_{CG}=180-\{(2.41\sim2.57) \times 10^{6}\}^{1/3.04}=(54.3\sim51.7)V$$

The required voltage is as follows if the wedge ratio thereof is 230%

$$V_{CG}=180-\{(3.41\sim3.85) \times 10^{6}\}^{1/3.04}=(39.1\sim33.4)V$$

The required voltage is as follows if the thickness of area A is in the range of 12.5~14.5 mm and the wedge ratio is 170% in case of the dark tint glass:

$$V_{CG}=180-\{(2.90\sim3.19) \times 10^{6}\}^{1/3.04}=(46.5\sim42.2)V$$

The required voltage is as follows if the wedge ratio thereof is 230%:

$$V_{CG}=180-\{(4.81\sim5.73) \times 10^{6}\}^{1/3.04}=(22.3\sim12.9)V$$

As a result, the difference between the aforementioned voltage and the signal voltage is the voltage of a correcting waveform around the edge area of the parabolic voltage.

To be specific, as shown in FIGS. 10*a* to 10*f*, the voltage $V_v$ of the correcting waveform around the edge area of the parabolic voltage is a voltage to be applied to the grid electrode 4 so as to display B when the signal level is white.

If the wedge ratio of the clear glass is 170%, the voltage $V_v$ is as follows in accordance with the thickness of A:

$$V_v=70V-(68.2\sim67.8)V=(1.8\sim2.2)V$$

If the wedge ratio thereof is 230%, the voltage $V_v$ is follows in accordance with the thickness of A:

$$V_v=70V-(66.5\sim65.9)V=(3.5\sim4.1)V$$

If the wedge ratio of the tint glass is 170%, the voltage $V_v$ is as follows in accordance with the thickness of A:

$$V_v=70V-(54.3\sim51.7)V=(25.7\sim28.3)V$$

If the wedge ratio thereof is 230%, the voltage $V_v$ is follows in accordance with the thickness of A:

$$V_v=70V-(39.1\sim33.4)V=(30.9\sim33.6)V$$

If the wedge ratio of the dark tint glass is 170%, the voltage $V_v$ is as follows in accordance with the thickness of A:

$$V_v=70V-(46.5\sim42.2)V=(23.5\sim27.8)V$$

If the wedge ratio thereof is 230%, the voltage $V_v$ is follows in accordance with the thickness of A:

$$V_v=70V-(22.3\sim19)V=(47.7\sim57.1)V$$

As described above, according to an embodiment of the present invention, vertical and horizontal parabolic voltages of the dynamic focus circuit are inputted in the grid electrode 4 of the brightness compensating device 11 as shown in 7, as in the case of the conventional cathode ray tube. The parabola input voltage is applied to the grid electrode 4 through the amplifying terminal, which comprises the transistor Q1 and the resistors R1, R2.

Figure 11:
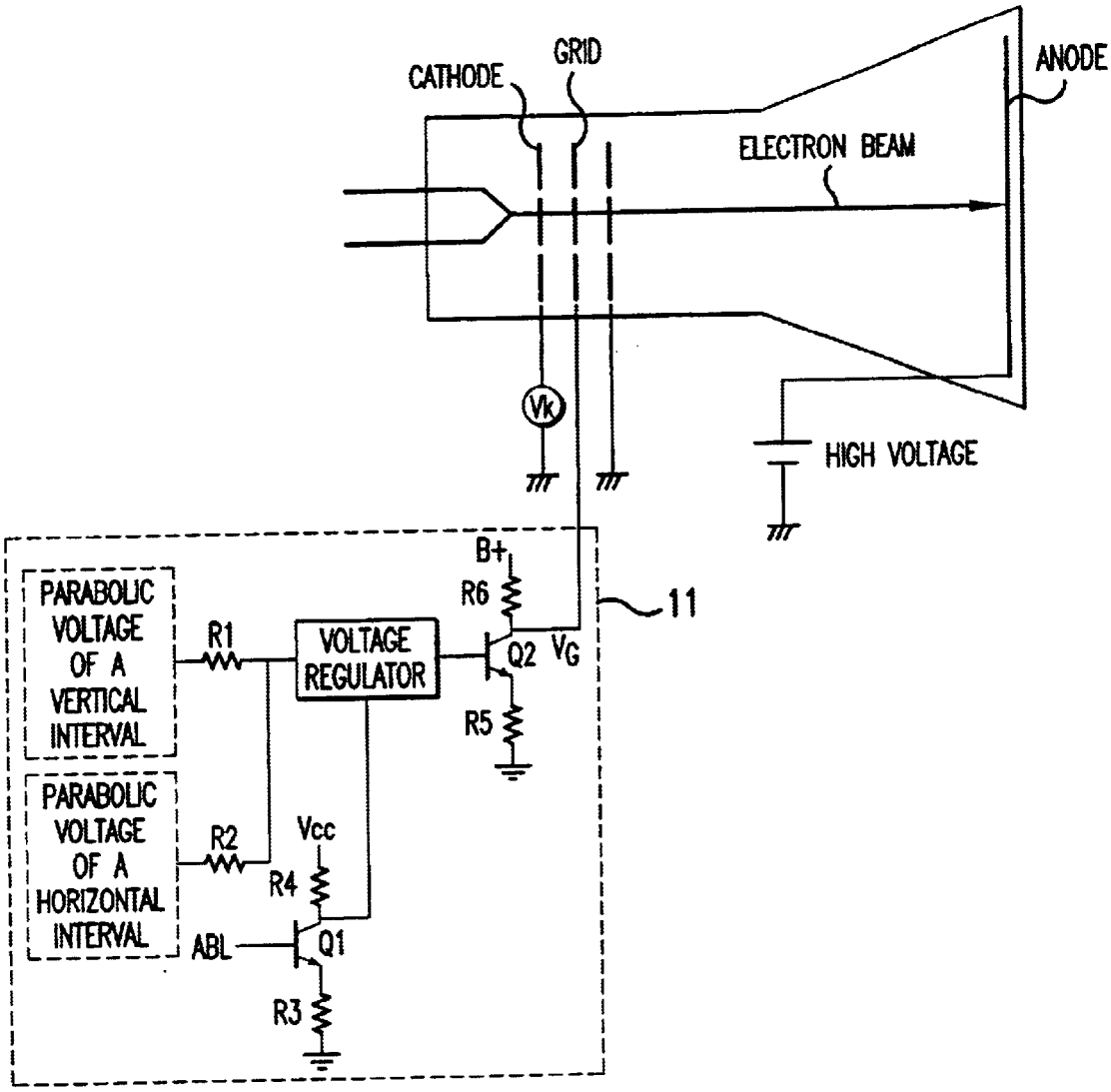
FIG. 11 is a diagram illustrating a mechanism of compensating for brightness according to another embodiment of the present invention.

However, the brightness compensating device 11 always applies a predetermined parabolic voltage to the grid electrode 4. Therefore, problems occur in brightness when displaying a black level or a white level throughout the entire screen. In other words, the brightness compensating device 11 applies the brightness compensating voltage even when displaying the black level, thereby deteriorating the background brightness and contrast. FIG. 11 is a diagram illustrating a brightness compensating device according to another embodiment of the present invention. Referring to FIG. 11, the brightness compensating device comprises a voltage control section for receiving vertical and horizontal parabolic voltages inputted in the dynamic focus circuit of the cathode ray tube operating circuit, a first amplifying section Q1 for receiving voltage in accordance with the beam current and inputting the amplified voltage in a control voltage of the voltage control section, and a second amplifying section Q2 for amplifying the vertical and horizontal parabolic voltages controlled in accordance with the output voltage of the first amplifying section Q1 so as to be applied to the grid electrode 4 of the electron gun.

The voltage control section comprises a volume control IC. The vertical and horizontal parabolic voltages are inputted in the voltage control section through resistors R1 and R2, respectively. The first and the second amplifying sections comprise transistors Q1 and Q2, respectively.

The parabolic voltages, in which vertical and horizontal cycles are mixed, connect to the resistors R1 and R2 the vertical and the horizontal voltages amounting to tens of volts at the front terminal of a second depositor in a circuit generating the dynamic focus voltage. The resistors R1 and R2 divided the voltages to control volume of the waveform of the vertical and the horizontal parabolic voltages. The divided voltages are inputted in the volume control IC, and voltages at an ABL terminal is connected by means of the volume control IC so as to sense variation of the voltage in accordance with the beam current.

The voltages of the ABL terminal is amplified with polarities reversed by the first amplifying section (the transistor Q1), an inputted in the control voltage of the volume control IC. The output of the volume control IC has different amplified ratios if accordance with the volume of the control voltage. Thus, the volume becomes greater where there is more beam current, while the volume becomes smaller where there is less beam current. The voltage of the volume control IC, which is very small in its volume, is amplified by the second amplifying section (the transistor Q2) and inputted in the grid electrode of the electron gun.

Thus, the ABL terminal senses the amount of beam current emitted by the cathode, and controls the parabolic voltage inputted in the grid electrode 4 of the electron gun in accordance with the sensed value so as to prevent excessive or deficient compensation for brightness.

While the above description exemplifies the case of applying the brightness compensating voltage to the grid electrode 4, similar effect can be obtained by applying the brightness compensating voltage to the accelerating electrode 5 adjacent to the grid electrode 4.

Cathode ray tubes having a screen with an almost flat outer face were recently launched. The screen has a curve ratio difference between an inner face and an outer face thereof. This results in the thickness difference between the middle area and the edge area of the screen. This is generally referred to as a wedge ratio. When a conventional formed mask is used, the wedge ratio ranges between 170% at the minimum and 230% at the maximum. Clear glass of high transmissibility is used for manufacturing a panel for a screen to overcome the brightness difference caused by the thickness difference. However, the clear glass also has a transmissibility higher than 75%. Therefore, to differentiate the brightness difference between the middle area and the edge area caused by an increase of the wedge ratio due to the different curve ratio between the inner face and the outer face of the screen in an almost flat cathode tube, it is suggested to differentiate the compensating degrees in accordance with variance of the beam current by using the voltage at the ABL terminal. Then, the brightness can be maintained in a uniform or constant ratio between the middle area and the edge area of the screen regardless of the brightness level of the screen.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A color image display device, comprising:

a panel housing a screen on an inner face thereof;

a funnel engaged with the panel;

an electron gun for emitting electron beams toward the screen, the electron gun including a triode section having a cathode for generating electron beams, a grid electron aligned to be adjacent to the cathode and an accelerating electrode aligned to be adjacent to the grid electrode;

a deflection device for displaying an image by deflecting the electron beams emitted from the electron gun in horizontal and vertical directions with respect to the screen;

a cathode ray tube including a shadow mask aligned from the screen at a predetermined distance; and a brightness compensating device for applying a variable voltage to the grid electrode or accelerating electrode, wherein said variable voltage applied to the grid electrode or the accelerating electrode is a parabolic waveform voltage, which increases from the middle area to the edge of the screen.

2. The color image display device of claim 1, wherein the cathode ray tube comprises a faceplate having a curved inner surface and a substantially flat outer surface.

3. The color image display device of claim 1 or 2, wherein the panel has a transmissibility of higher than 75% and the following equation (1) is satisfied, where the beam current $I_B$ represents the edge area and the beam current $I_A$ represents the middle area of the display screen:

$$(1.052\sim1.098)I_A \leqq I_B \leqq (1.060\sim1.115)I_A \quad (1).$$

4. The color image display device of claim 1 or 2, wherein the panel has a transmissibility higher than 45% but lower than 75% and the following equation (2) is satisfied, where the beam current $I_B$ represents the edge area and the beam current $I_A$ represents the middle area of the display screen:

$$(1.499\sim2.121)I_A \leqq I_B \leqq (1.599\sim2.392)I_A \quad (2).$$

5. The color image display device of claim 1 or 2, wherein the panel has a transmissibility lower than 45% and the following equation (3) is satisfied, where the beam current $I_B$ represents the edge area and the beam current $I_A$ represents the middle area of the display screen:

$$(1.803\sim2.988)I_A \leqq I_B \leqq (1.981\sim3.561)I_A \quad (3).$$

6. The color image display device of claim 3, wherein the following equation (4) is satisfied when the signal level is white, where the beam current $I_B$ represents the edge area and the beam current $I_A$ represents the middle area of the display screen:

$$(1.69\sim1.71)\text{mA} \leqq I_B \leqq (1.77\sim1.80)\text{mA} \quad (4).$$

7. The color image display device of claim 1 or 2, wherein the following equation (5) is satisfied when the signal level is white and the voltage Vv represents the voltage applied to the grid electrode or the accelerating electrode for displaying the edge of the display screen:

$$(1.8\sim2.2)V \leqq Vv \leqq (3.5\sim4.1)V \quad (5).$$

8. The color image display device of claim 4, wherein the following equating (6) is satisfied when the signal level is white, and the voltage Vv represents the voltage applied to the grid electrode or the accelerating electrode, where the beam current $I_B$ represents the edge area and the beam current $I_A$ represents the middle area of the display screen:

$$(2.41\sim2.57)\text{mA} \leqq Vv \leqq (3.41\sim3.85)\text{mA} \quad (6).$$

9. The color image display device of claim 1 or 2, wherein the following equation (7) is satisfied when the signal level is white and the voltage Vv represents the voltage applied to the grid electrode or the accelerating electrode for displaying the edge of the display screen:

$$(25.7\sim28.3)V \leqq Vv \leqq (30.9\sim36.6)V \quad (7).$$

10. The color image display device of claim 5, wherein the following equation (8) is satisfied when the signal level is white, and the voltage Vv represents the voltage applied to the grid electrode or the accelerating electrode, where the beam current $I_B$ represents the edge area and the beam current $I_A$ represents the middle area of the display screen:

$$(2.90\sim3.19)\text{mA} \leqq Vv \leqq (4.81\sim5.73)\text{mA} \quad (8).$$

11. The color image display device of claim 5, wherein the following equating (9) is satisfied when the signal level is white and the voltage Vv represents the voltage applied to the grid electrode or the accelerating electrode for displaying the edge of the display screen:

$$(23.5\sim27.8)V \leqq Vv \leqq (47.7\sim57.1)V \quad (9).$$

12. A color image display device, comprising:

a panel housing a screen on an inner face thereof;

a funnel engaged with the panel;

an electron gun for emitting electron beams toward the screen, the electron gun including a triode section having a cathode for generating electron beams, a grid electrode aligned to be adjacent to the cathode and an accelerating electrode aligned to be adjacent to the grid electrode;

a deflection device for displaying an image by deflecting the electron beams emitted from the electron gun in horizontal and vertical directions with respect to the screen; and a cathode ray including a shadow mask aligned from the screen at a predetermined distance; and a brightness compensating device for applying a brightness compensating voltage for compensating a brightness difference in accordance with thickness of the panel glass to the grid electrode or the accelerating electrode, the brightness compensating voltage having a parabolic waveform, which increases from the middle area to the edge of the screen and is variable depending on the a beam current emitted from the cathode.

13. A color image display device of comprising:

a panel having a screen on an inner surface thereof;

a funnel engaged with the panel;

an electron gun emitting electron beams toward the screen, the electron gun including a triode section having a cathode for generating electron beams, a grid electrode aligned to be adjacent to the cathode and an accelerating electrode aligned to be adjacent to the grid electrode;

a deflection device for displaying an image by deflecting the electron beams emitted from the electron gun in horizontal and vertical directions with respect to the screen;

a cathode ray including a shadow mask aligned from the screen at a predetermined distance;

a brightness compensating device applying a brightness compensating voltage for compensating a brightness difference in accordance with thickness of the panel glass to the grid electrode or the accelerating electrode, the brightness compensating voltage having a parabolic waveform, which increases from the middle area to the edge of the screen and is variable depending on the a beam current emitted from the cathode, the brightness compensating device further including, a voltage control section for controlling vertical and horizontal parabolic voltages inputted in accordance with the beam current values;

a first amplifying section for amplifying the voltage in accordance with the beam current; and a second amplifying section for amplifying the output of the voltage control section.

14. The color image display device of claim 12, wherein the beam current is sensed by an ABL output terminal.

15. The color image display device of claim 13, wherein the vertical and horizontal parabolic voltages are voltages outputted from a dynamic focus circuit.

16. The color image display device of claim 13, wherein the voltage control section is a volume control IC.

17. The color image display device of any one of claim 1, 2 or 12, wherein a wedge ratio of the panel (a thickness ratio of the edge area with respect to the middle area of the panel) ranges between 170~230%.

18. The color image display device of any one of claims 1, 2 or 12, wherein the thickness of the middle area of the panel ranges between 12.5~14.5 mm.

* * * * *